US009608337B2

(12) United States Patent
Lee et al.

(10) Patent No.: US 9,608,337 B2
(45) Date of Patent: Mar. 28, 2017

(54) BUILT-IN ANTENNA FOR ELECTRONIC DEVICE

(71) Applicant: Samsung Electronics Co., Ltd., Gyeonggi-do (KR)

(72) Inventors: Kyung-Jong Lee, Gyeonggi-do (KR); Seung-Hwan Kim, Seoul (KR); Dong-Hwan Kim, Gyeonggi-do (KR); Austin Kim, Gyeonggi-do (KR); Young-Sung Lee, Gyeonggi-do (KR); Jae-Ho Lee, Gyeonggi-do (KR); Jae-Bong Chun, Gyeonggi-do (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 0 days.

(21) Appl. No.: 14/947,188

(22) Filed: Nov. 20, 2015

(65) Prior Publication Data

US 2016/0079683 A1 Mar. 17, 2016

Related U.S. Application Data

(63) Continuation of application No. 13/761,289, filed on Feb. 7, 2013, now Pat. No. 9,219,305.

(30) Foreign Application Priority Data

Mar. 19, 2012 (KR) ..... 10-2012-0027681

(51) Int. Cl.
*H01Q 21/30* (2006.01)
*H01Q 5/364* (2015.01)
(Continued)

(52) U.S. Cl.
CPC ..... *H01Q 21/30* (2013.01); *H01Q 1/243* (2013.01); *H01Q 1/50* (2013.01); *H01Q 5/364* (2015.01);
(Continued)

(58) Field of Classification Search
None
See application file for complete search history.

(56) References Cited

U.S. PATENT DOCUMENTS 8,743,014 B2 6/2014 Kondo et al.
2007/0241971 A1 10/2007 Tsujimura et al.
(Continued)

FOREIGN PATENT DOCUMENTS

CN 101563811 A 10/2009
CN 102138252 A 7/2011
(Continued)

OTHER PUBLICATIONS

Chinese Search Report dated Jul. 18, 2016.
European Search Report dated Nov. 30, 2016.

*Primary Examiner* — Robert Karacsony
(74) *Attorney, Agent, or Firm* — Cha & Reiter, LLC.

(57) ABSTRACT

A built-in antenna for an electronic device is provided. The built-in antenna includes a substrate, a 1st antenna radiator with at least two radiating portions, a 2nd antenna radiator, and a switching means. The substrate has a conductive area and a non-conductive area. The 2nd antenna radiator is arranged within the non-conductive area of the substrate and fed by a Radio Frequency (RF) end of the substrate. The 2nd antenna radiator is configured to operate at a band different from at least one operating band of the 1st antenna radiator, and is fed by the RF end in a position adjacent the 1st antenna radiator. The switching means switches to selectively feed the 1st antenna radiator and the 2nd antenna radiator.

16 Claims, 5 Drawing Sheets

(51) Int. Cl.

| | |
|---|---|
| ***H01Q 5/378*** | (2015.01) |
| ***H01Q 1/24*** | (2006.01) |
| ***H01Q 9/42*** | (2006.01) |
| ***H01Q 1/50*** | (2006.01) |
| ***H01Q 5/371*** | (2015.01) |

(52) U.S. Cl.
CPC ..... *H01Q 5/371* (2015.01); *H01Q 5/378* (2015.01); *H01Q 9/42* (2013.01)

(56) References Cited

U.S. PATENT DOCUMENTS

| | | | | |
|---|---|---|---|---|
| 2007/0273606 | A1 | 11/2007 | Mak et al. | |
| 2010/0090909 | A1 | 4/2010 | Ella | |
| 2011/0134014 | A1 | 6/2011 | Kondo et al. | |
| 2012/0001815 | A1 | 1/2012 | Wong et al. | |
| 2012/0105286 | A1* | 5/2012 | Rhyu ..... | H01Q 1/243 343/702 |

FOREIGN PATENT DOCUMENTS

| | | | |
|---|---|---|---|
| EP | 2 117 072 | A1 | 11/2009 |
| EP | 2 448 061 | A1 | 5/2012 |
| WO | 2008/075133 | A1 | 6/2008 |

* cited by examiner

BUILT-IN ANTENNA FOR ELECTRONIC DEVICE

CROSS REFERENCE TO RELATED APPLICATIONS

This is a Continuation application of U.S. patent application Ser. No. 13/761,289 filed on Feb. 7, 2013 which claims priority under 35 U.S.C. §119(a) to a Korean Patent Application filed in the Korean Intellectual Property Office on Mar. 19, 2012 and assigned Serial No. 10-2012-0027681, the contents of which are herein incorporated by reference.

BACKGROUND

1. Technical Field

The present disclosure relates generally to a built-in antenna for an electronic device, and more particularly, to a multi-band built-in antenna electronic device.

2. Description of the Related Art

A portable terminal is generally considered any hand-held electronic device that can transmit and/or receive an RF signal. Examples of portable terminals include cell phones, smart phones, tablet PCs, personal digital assistants (PDAs), game devices, e-books, digital cameras and navigation devices. As technology has advanced and more functionality has been added to mainstream models, the goal of providing a slim and aesthetic design has remained an important consideration electronic device. Terminal manufacturers are racing to realize the same or improved functions while making the portable terminal smaller and slimmer than older designs.

Modern portable terminals employ at least one built-in antenna for communication functions such as voice and video calls and wireless Internet surfing. Built-in antennas are on a trend of operating at two or more bands (i.e., multi-band), minimizing an antenna mounting space of the portable terminal, reducing a volume thereof, and expanding a function thereof.

A popular design for the multi-band built-in antenna is a Planar Inverted F Antenna (PIFA). For example, a built-in antenna has been designed to cover main frequency bands of Global Systems for Mobile communication (GSM) 900, Digital Cellular Service (DCS) 1800, Personal Communications Service (PCS) 1900, and Wireless Code Division Multiple Access (WCDMA) Band1, and has been widely used. The built-in antenna has been provided for complete coverage of a set of low bands, e.g., GSM 850 and GSM900 switched therebetween through a switching technology using a separately added ground pad. Such "ground-pad switching technology" involves the use of one or more in-line switches between one or more points on the antenna conductor and ground-connected pads to vary an antenna configuration according to the switching states. Switching is performed to optimize antenna performance at a desired band.

In recent years, besides operating at the aforementioned bands, portable terminals using Long Term Evolution (LTE) technology, i.e., the so-called $4^{th}$-Generation (4G) are emerging. In some cases, the LTE terminals operate at a frequency band higher than those of 2-Generation (2G) or 3-Generation (3G) bands. For instance, LTE terminals may operate at LTE Band1 (2500 MHz to 2690 MHz), and LTE Band11 (1428 MHz to 1496 MHz). Accordingly, recently released terminals deploy an antenna operating at the LTE Bands separate from an antenna operating at the 2G (GSM900, DCS1800, and PCS1900) and 3G (WCDMA Band1, 2, 5, 8, etc.) bands.

However, with ground pad switching technology, it is difficult to cover a penta band that includes the relatively high bands of LTE Band7 and LTE Band11. Accordingly, the conventional approach is to isolate and mount a GSM Quad-Band antenna and an LTE-Band antenna, separately.

On the other hand, the ground pad switching technology is suitably used at low bands such as GSM900 and GSM850 switched therebetween. The switching states of the switches are controlled to shift the resonant frequency of the antenna for operation at one band or the other. However, using this scheme, the amount of frequency shift obtainable is limited to about 60 MHz. This limitation stems from the difficulty in securing as much spaced distance between radiators. as desired. Ground pad switching technology can increase a frequency shift but has been known to change antenna impedance and deteriorate basic antenna performance. Also, the capability of covering at least two high bands of 1 GHz or more such as DCS band (1710 MHz to 1850 MHz) and LTE Band11 (1428 MHz to 1496 MHz) is desirable. In this case, the band centers are separated by about 300 MHz. In order to switch between these bands using ground pad switching technology, a complex design is needed, which undesirably trades off antenna performance. Thus, separate antennas are typically provided for the two bands.

Accordingly, the aforementioned application of the separate antenna runs counter to the recent trend of simultaneously realizing slimming down and multi-functionality of the electronic device. Furthermore, the added antenna and complexity increases manufacturing cost.

SUMMARY

An aspect of the present invention is to provide a multi-band built-in antenna for an electronic device, realized in a compact design electronic device to reduce an installation space, thereby contributing to the slimming of the device, and also saving manufacturing cost.

According to one aspect of the present invention, a built-in antenna for an electronic device is provided. The built-in antenna includes a substrate, a 1st antenna radiator with at least two radiation patterns, a 2nd antenna radiator, and a switching means. The substrate has a conductive area and a non-conductive area. The 2nd antenna radiator is arranged within the non-conductive area of the substrate and fed by a Radio Frequency (RF) end of the substrate. The 2nd antenna radiator is arranged to operate at a band different from at least one operating band of the 1st antenna radiator, and fed by the RF end in a position adjacent the 1st antenna radiator. The switching means switches to selectively feed the 1st antenna radiator and the 2nd antenna radiator.

Preferably, during operation of the first antenna radiator, the second antenna radiator is disconnected from the RF end but is electromagnetically coupled to the first antenna radiator in a manner which improves the antenna performance of the first antenna radiator. The second antenna radiator may be used at an LTE band while the first antenna radiator is used for four other bands of the 2G and 3G protocols. The arrangement enables a penta-band antenna to be deployed in a smaller space of a portable terminal than has been otherwise possible.

BRIEF DESCRIPTION OF THE DRAWINGS

The above and other aspects, features and advantages of the present invention will become more apparent from the following detailed description when taken in conjunction with the accompanying drawings in which.

DETAILED DESCRIPTION

Exemplary embodiments of the present invention will be described herein below with reference to the accompanying drawings. In the following description, well-known functions or constructions are not described in detail since they would obscure the invention in unnecessary detail. And, terms described below, which are defined considering functions in the present invention, can differ in meaning depending on user and operator's intent or practice. Therefore, the terms should be understood on the basis of the disclosure throughout this specification.

The following detailed description illustrates and describes a portable terminal as an electronic device, but this does not intend to limit the scope and spirit of the invention. For example, the present invention shall be applicable to electronic devices of various fields used for communication, although not portable.

Figure 1:
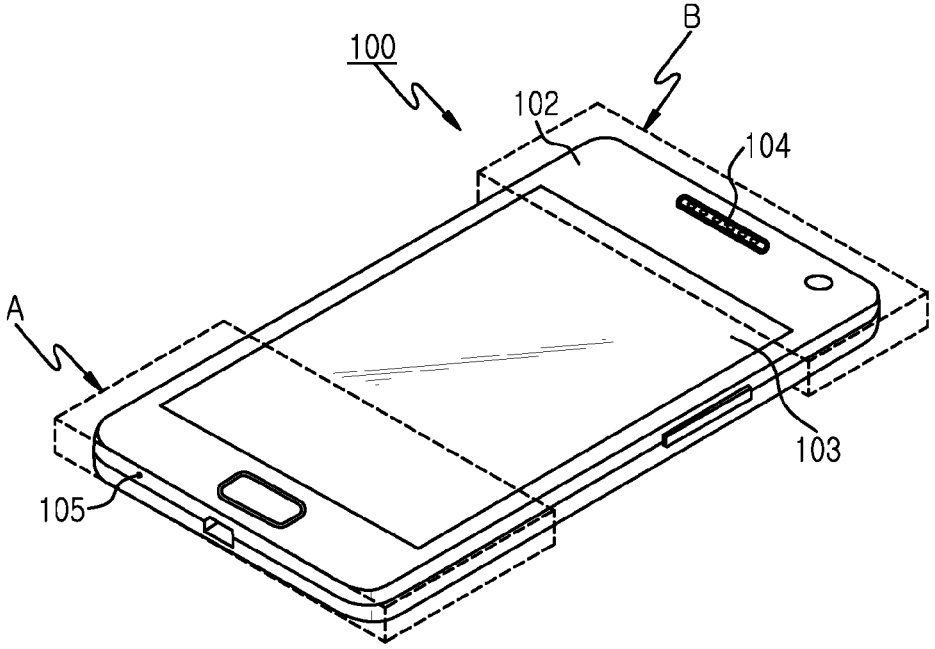
FIG. 1 is a perspective view of a portable terminal as an electronic device installing a built-in antenna according to an exemplary embodiment of the present invention.

FIG. 1 is a perspective view illustrating a portable terminal as an electronic device installing a built-in antenna according to an exemplary embodiment of the present invention. Portable terminal 100 includes a display 103 installed on a front surface 102 thereof. The display 103 can be a touch screen capable of simultaneously performing data input and output. A speaker 104 is disposed above the display 103, for outputting audio of a caller's voice, music, etc. Below the display 103 is installed a microphone 105 for inputting sound such as during a call. Although not illustrated, a camera module and other supplementary devices for realizing well-known supplementary functions may be further installed in the portable terminal 100.

A built-in antenna (e.g., antenna 1 of FIG. 2) according to the present invention can be deployed in various positions of the portable terminal 100. For example, the built-in antenna 1 can be configured to operate at five bands (i.e., a penta-band antenna). To this end, the antenna can be comprised of a quad-band antenna radiator constructed to cover 2G (Global Systems for Mobile communication (GSM) 900, Digital Cellular Service (DCS) 1800, and Personal Communications Service (PCS) 1900) and 3G (Wireless Code Division Multiple Access (WCDMA) Band1, 2, 5, 8, etc.) bands, and an LTE-band antenna radiator covering an LTE band as the fifth band. The penta-band antenna radiator is preferably installed in portable terminal 100 within a bottom side (i.e., the 'A' portion) or a top side (i.e., the 'B' portion) In contrast, a conventional antenna occupies both the A and B portions to isolate and install a quad-band antenna radiator constructed to cover the existing 2G (GSM900, DCS1800, and PCS1900) and 3G (WCDMA Band1, 2, 5, 8, etc.) bands and an LTE-band antenna radiator covering the LTE band. Hence the built-in antenna according to the present invention can save installation space. Further, as explained fully below, at a time the quad-band antenna radiating portion operates, an LTE-band antenna radiating portion is electrically opened from a feeding portion by a predetermined switching means and is simultaneously used as a floating dummy pattern. This scheme serves to expand a bandwidth of the quad-band antenna radiator.

Figure 2:
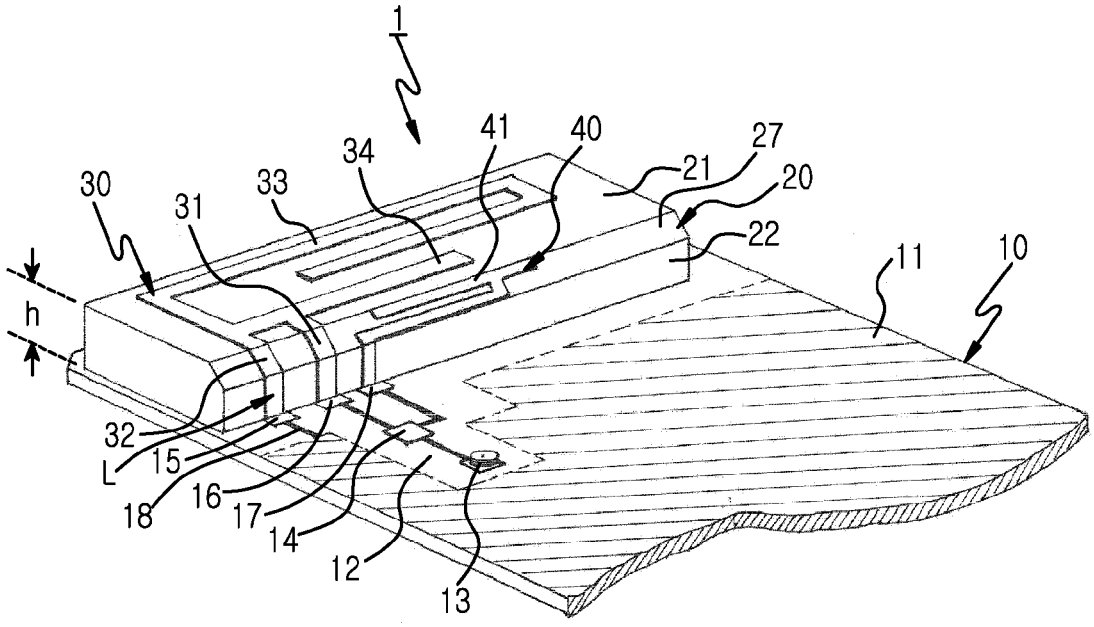
FIG. 2 is a perspective view of a built-in antenna applied to the portable terminal of FIG. 1 according to an exemplary embodiment of the present invention.

FIG. 2 is a perspective view of a built-in antenna applied to the portable terminal of FIG. 1 according to an exemplary embodiment of the present invention. The built-in antenna 1 includes a substrate (e.g., a Printed Circuit Board (PCB)) 10, and 1st and 2nd antenna radiators 30 and 40, respectively. The substrate 10 is installed within the portable terminal 100 and mounts various electronic components (not shown) performing respective functions. The 1st and 2nd antenna radiators 30 and 40 are arranged atop the substrate 10. In the embodiment shown in FIG. 2, radiators 30 and 40 are formed on a carrier 20 which is mounted on a non-conductive surface 12 of the substrate 10. In other embodiments, the carrier 20 is omitted and radiators 30 and 40 are formed as patterns directly on the non-conductive area 12, or embodied as a plate type conductor, or as a flexible printed circuit including a pattern or the like attached to the substrate 10. As another alternative, the 1st and 2nd antenna radiators 30 and 40 may be, if a space is available, formed or installed on an inner side surface of a housing forming an external appearance of the terminal 10.

In one implementation, the 1st antenna radiator 30 is formed as a quad-band antenna radiator for covering 2G (GSM900, DCS1800, and PCS1900) and 3G (WCDMA Band1, 2, 5, 8, etc.) bands. In this case, the 2nd antenna radiator 40 can be formed as an LTE-band antenna radiator for covering an LTE band.

The 1st antenna radiator 30 is configured as a type of Planar Inverted F Antenna (PIFA). The 2nd antenna radiator 40 is embodied as a type of monopole antenna radiator having a feed structure that bends and branches into an end portion resembling a T-pattern. Also, a predetermined switching means 40 is provided to switch an RF end 13 between the first radiator 30 and the second radiator 40. When the 1st antenna radiator 30 operates, the 2nd antenna radiator 40 is electrically opened from a feeding portion connected to the RF end 13 such that LTE band communication is disabled. In this condition, i.e., while the 1st antenna radiator 30 operates, the 2nd antenna radiator 40 is coupled with the 1st antenna radiator 30 to operate as a sub antenna radiator. This coupling arrangement improves antenna performance of the first radiator 30, making it possible to switch between bands having frequencies differing by 300 MHz or more while maintain requisite performance metrics. The unique coupling arrangement overcomes a problem of isolation, efficiency deterioration and the like occurring when two different antennas come close to each other.

In the FIG. 2 embodiment, the 1st and 2nd antenna radiators 30 and 40 are installed on a carrier 20. The carrier 20 includes a planar top surface 21 and a side surface 22 extending perpendicularly from the top surface 21. The top surface 21 is spaced at a constant height h from the surface 12 of the substrate 10 due to uniform thickness of the carrier 20. A tapered section 27 is provided between the top surface 21 and the side surface 22 (the side surface 22 extends perpendicularly from the substrate 10 to a height smaller than h). Major portions of the 2nd antenna radiator 40 are disposed in the tapered section 27. Leg portions L of both antenna radiators 30 and 40 extend perpendicularly on the side surface 22 from the conductors on the tapered section 27. In other embodiments, the tapered section 27 can be omitted; in this case, the 2nd antenna radiator 40 would be disposed on the top surface 21, i.e., on the same plane as the 1st antenna radiator 30. However, certain antenna performance metrics may be improved by providing the tapered section 27 in relation to the conductors in the manner shown. As mentioned above, the carrier 20 may be omitted, such that the antenna radiators may be printed directly on the substrate 10. However, if included, a material with a higher or lower dielectric constant than the substrate 10 can be used for the carrier, whereby the antenna performance characteristics may be influenced. The radiator dimensions can be tailored in accordance with the dielectric constant. For the case of a higher dielectric constant, the antenna radiator dimensions can be made smaller for operation at the same frequency bands, but typically at the expense of a higher transmission loss. Further, by including the carrier 20 with a height h, a portion of each of the antenna radiators 30 and 40 extends in the perpendicular direction (Z direction), such that the total space occupied in the X-Y plane can be made smaller for the same total length radiators. Thus, if Z direction space is available within the portable terminal, a space tradeoff may favor the utilization of the carrier 20.

The substrate 10 includes a conductive area 11 and a non-conductive area 12 spaced laterally from each other on the same planar top surface of substrate 10. According to the present invention, the 1st and 2nd antenna radiators 30 and 40 are arranged in the non-conductive area 12. A ground pad 15 and 1st and 2nd feeding pads 16 and 17 are disposed in the non-conductive area. The ground pad 15 is electrically connected to the conductive area 11 through a conductive line 18. The 1st and 2nd feeding pads 16 and 17 are electrically connected to a Radio Frequency (RF) end 13 through conductive lines and the switching means 14 interposed between the 1st and 2nd feeding pads 16 and 17 and the RF end 13. Only one of the 1st and 2nd feeding pads 16 and 17 is selected to electrically connect with the RF end 13 at a given time. The switching means 14 may be at least one of the well known Micro Electro Mechanical System (MEMS), Field Effect Transistor (FET), and diode switch. The RF end 13 connects to RF components (not shown) of portable terminal 10, and to the antenna feed line (i.e., the electrical connection to the switch 14) in any suitable conventional manner.

The 1st antenna radiator 30, which is a type of PIFA, includes a grounding portion 32 on a near end (the left end in the view of FIG. 2) and a feeding portion 31, where the two portions 31, 32 are formed as lines spaced apart and parallel to one another in the examples herein. Note that each radiator "portion" referred to herein is a conductive strip portion of the overall radiator, which runs in a line or line pattern, and preferably having uniform width as shown. The grounding portion 32 is electrically connected to the ground pad 15. The feeding portion 31 is electrically connected to the 1st feeding pad 16. Also, the 1st antenna radiator 30 includes a 1st radiating portion 33 in the form of an L shape connected to a U shape, and a 2nd radiator portion 34 in the form of a straight line perpendicular to the grounding portion 32. The 2nd radiating portion 34 runs parallel to an end portion (open end portion) of the U shape of the 1st radiating portion 33. Grounding portion 32 functions to provide a reactance to each of the antenna radiating portions 33 and 34, enabling the antenna 1 to be adequately tuned at desired frequencies.

Here, the 1st radiator portion 33 can be realized to operate at one or more relatively low bands, e.g., at a band of GSM900 (880 MHz to 960 MHz). The 2nd radiator portion 34 can be realized to operate at one or more relatively high bands, for instance, at a band of DCS1800 (1710 MHz to 1880 MHz), PCS1990 (1850 MHz to 1990 MHz), and WCDMA Band1 (1920 MHz to 2170 MHz). Accordingly, it is advantageous that the 2nd radiator portion 34 is formed in a pattern capable of supporting a wide bandwidth so it can operate at the aforementioned various bands. As described below, the antenna performance of 1st antenna radiator 30 is improved due to the presence of 2nd antenna radiator 40 acting as a dummy element which is electromagnetically coupled to at least one of the first and second radiating portions 33, 34 of the first antenna radiator 30.

In the embodiment illustrated, the 2nd radiating portion 34 connects to the grounding portion 32 at the near end and extends perpendicularly from the intersection at the grounding portion 32 by a specific length. The feed portion 32 connects to a point of the 2nd radiating portion 34 which is offset from the near end. This connection point is closer to the near end than to the far end of 2nd radiating portion 34 in the illustrative embodiment.

The 2nd antenna radiator 40, which is of a monopole type, is arranged in a position in which coupling with the 1st antenna radiator 30 is possible so that, when the 1st antenna radiator 30 operates, the 2nd antenna radiator 40 can be used as a floating dummy pattern. Desirably, the 2nd antenna radiator 40 can be arranged near the 2nd radiator portion 34, and operates at a higher band than the bands designated for use by the 1st antenna radiator 30. Accordingly, the 2nd antenna radiator 40 is composed of 3rd radiating portion 41. The 3rd radiating portion 41 is electrically connected to the 2nd feeding pad 17, which is arranged in the non-conductive area 12 of the substrate 10. The 3rd radiating portion 41 is designed with two major portions that run parallel to the 2nd radiating portion 34, which result in an enhancement of antenna performance of the 1st antenna radiator 30 due to near field coupling. The 2nd antenna radiator can operate at an LTE band, e.g., at a band of LTE Band11 (1428 MHz to 1496 MHz) or LTE Band7 (2500 MHz to 2690 MHz).

Figure 3:
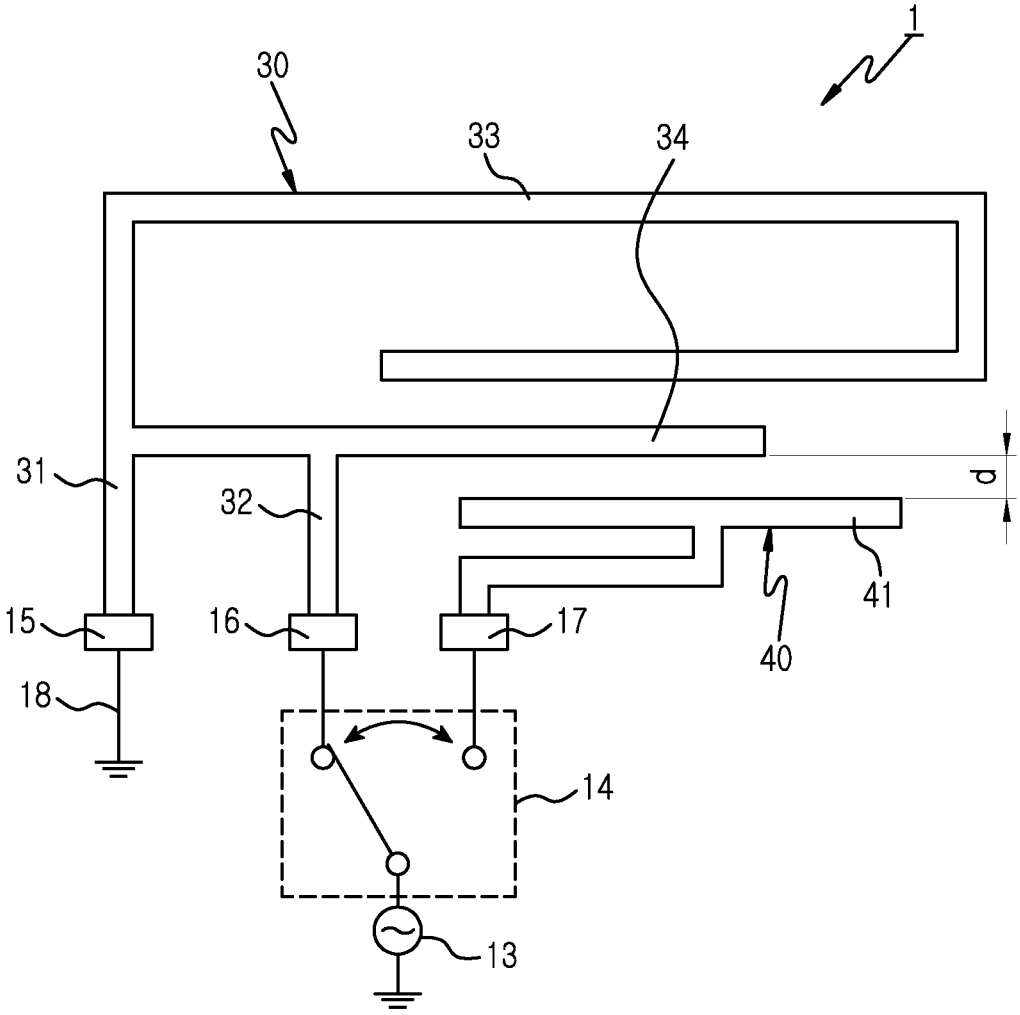
FIG. 3 is a plan/schematic view illustrating a state of operating a 1st antenna radiator of the built-in antenna of FIG. 2 according to an exemplary embodiment of the present invention.
Figure 4:
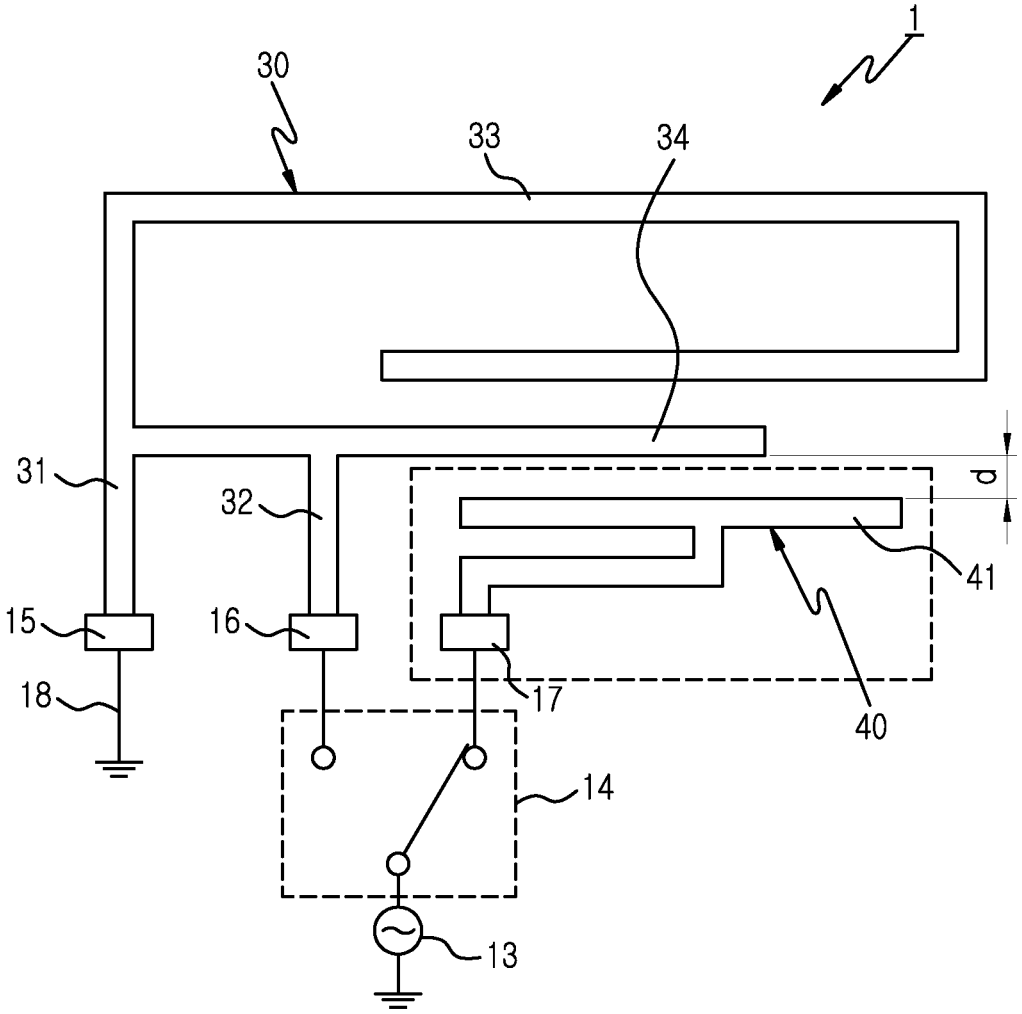
FIG. 4 is a plan/schematic view illustrating a state of operating a 2nd antenna radiator of the built-in antenna of FIG. 2 according to an exemplary embodiment of the present invention.
Figure 5A:
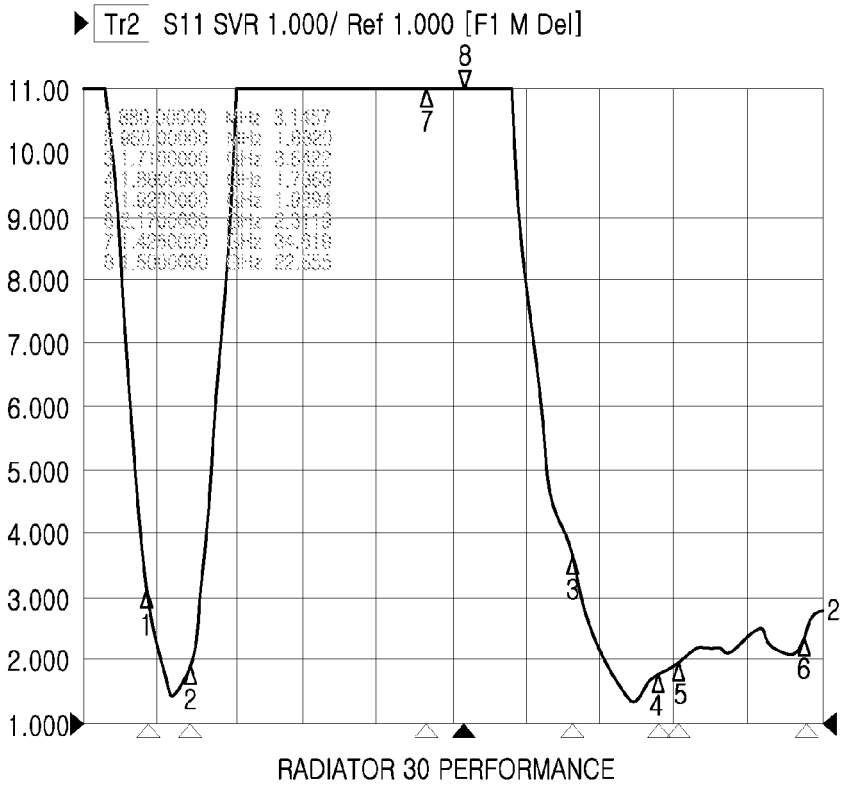
FIG. 5A and FIG. 5B are graphs illustrating a Voltage Standing Wave Ratio (VSWR) of the built-in antenna of FIG. 2 according to an exemplary embodiment of the present invention.
Figure 5B:
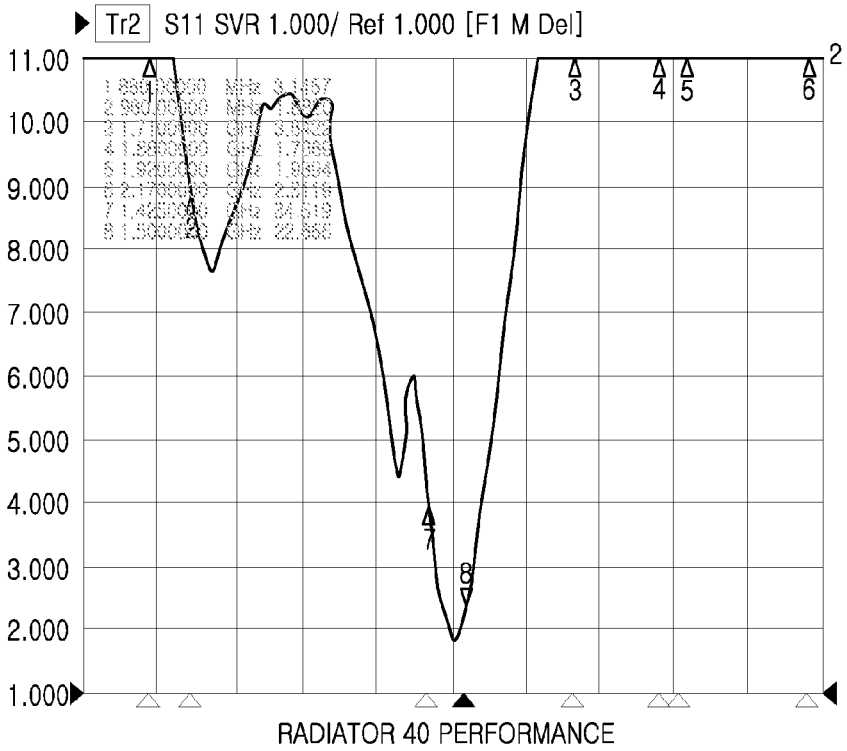

FIG. 3 is a plan/schematic view of the built-in antenna of FIG. 2, showing only the conductive strips of the antenna radiators in plan view, without the carrier and substrate, and with the electrical connections and switching state of switch 14 shown schematically. The view illustrates an operating state of the 1st antenna radiator 30 of the built-in antenna 1 of FIG. 2 according to an exemplary embodiment of the present invention. Note that the plan view omits lines demarcating the edges of the antenna radiators defined by the tapered portion 27, for clarity of illustration. FIG. 3 is applicable to a built-in antenna 1 in embodiments that either include or omit the carrier 20. FIG. 4 is a plan/schematic view illustrating an operating state of the 2nd antenna radiator 40 of the built-in antenna 1 of FIG. 2 according to an exemplary embodiment of the present invention. FIG. 4 is likewise applicable to a built-in antenna 1 in embodiments that either include or omit the carrier 20. FIGS. 5A and 5B are graphs illustrating a Voltage Standing Wave Ratio (VSWR) of the built-in antenna 1 of FIG. 2 according to an exemplary embodiment of the present invention.

FIG. 5A is a graph illustrating a VSWR of the 1st antenna radiator 30 operable at quad bands of GSM900, DCS1800, PCS1900, and WCDMA Band1. FIG. 5B is a graph illustrating a VSWR of the 2nd antenna radiator 40 operable at LTE Band11.

As illustrated in FIG. 3, the RF end 13 is electrically connected with a feeding portion 32 of the 1st antenna radiator 30 through a 1st feeding pad 16 by switching means 14 to feed RF power to/from the 1st antenna radiator 30 (i.e., the 1st antenna radiator 30 is considered in an operational state). In this state, the RF end 13 is not connected with the 2nd antenna radiator 40. However, the 3rd radiator portion 41 of the 2nd antenna radiator 40 is arranged in a position close to radiating portion 34 of the 1st radiator 30, and is thus electromagnetically coupled to radiator portion 34. When the 1st antenna radiator 30 operates, the 3rd radiator portion 41 plays a role of operating as a floating dummy pattern, which serves to expand an operating bandwidth of the 2nd radiator portion 34. Here, it is desirable that a spaced distance (d) for coupling between the 2nd radiator portion 34 and the 3rd radiator portion 41 has a range of about 0.5 millimeter (mm) to 5 mm.

Accordingly, as illustrated in FIG. 5A, it can be appreciated that the 2nd radiator portion 34 of the 1st antenna radiator 30 operates efficiently at an expanded bandwidth at relatively high bands of DCS1800, PCS1900, and WCDMA Band1Note that without the presence of radiating portion 41 acting as a floating dummy pattern, the S11 values of graph (a) are generally higher at the bands of interest. That is, the electromagnetic coupling of radiating portion 41 produces a tuning effect for the high bands supported by antenna radiator 30. (The coupling may also produce a tuning effect for the low bands supported by radiating portion 33 to improve performance.) Reflected energy from surface currents induced in radiating portion 41 alters the surface current distribution along radiating portion 34 to improve the VSWR parameter S11 over the bands of interest. Radiating portion 41 becomes a sub antenna radiator in the operating state of antenna radiator 30.

On the other hand, as illustrated in FIG. 4, only the 2nd antenna radiator 40 is operated when the RF end 13 is electrically connected to 2nd feeding pad 17 of the 2nd antenna radiator 40 by the switching means 14. Accordingly, as illustrated in FIG. 5B, the 2nd antenna radiator 40 is operated efficiently at an LTE band, in this example, LTE Band11.

TABLE 1

| | | | | Average per Band | |
|---|---|---|---|---|---|
| Frequency (MHz) | Peak (dbi) | Average (dbi) | Efficiency (%) | Efficiency (%) | Average (dbi) |
| 880 | −1.0 | −5.2 | 30 | 51% | −0.38 |
| 896 | 0.5 | −4.0 | 40 | | |
| 912 | 1.5 | −3.0 | 50 | | |
| 928 | 2.4 | −2.2 | 60 | | |
| 944 | 2.5 | −2.1 | 62 | | |
| 960 | 2.6 | −1.9 | 64 | | |
| 1710 | −0.9 | −5.7 | 27 | 40% | −4.04 |
| 1745 | −0.5 | −5.0 | 32 | | |
| 1785 | −0.1 | −4.1 | 39 | | |
| 1805 | 0.2 | −3.5 | 45 | | |
| 1840 | 0.3 | −3.1 | 49 | | |
| 1880 | 0.4 | −3.0 | 50 | | |
| 1920 | 0.7 | −2.3 | 59 | 60% | −2.22 |
| 1950 | 1.2 | −1.9 | 64 | | |
| 1980 | 1.2 | −2.0 | 63 | | |
| 2110 | 1.3 | −2.5 | 56 | | |
| 2140 | 1.6 | −2.2 | 60 | | |
| 2170 | 1.8 | −2.4 | 58 | | |
| 1425 | 0.4 | −4.7 | 34 | 39% | −4.05 |

TABLE 1-continued

| | | | | Average per Band | |
|---|---|---|---|---|---|
| Frequency (MHz) | Peak (dbi) | Average (dbi) | Efficiency (%) | Efficiency (%) | Average (dbi) |
| 1450 | −0.7 | −4.0 | 38 | | |
| 1475 | 0.2 | −3.5 | 45 | | |
| 1500 | −0.1 | −4.1 | 39 | | |

In the above Table 1, the peak indicates a peak antenna gain in dbi unit and the average indicates an average antenna gain in dbi unit and the efficiency indicates an efficiency of data transmission for an exemplary antenna in % for corresponding frequency.

Also, as seen in Table 1 above, it can be appreciated that a construction of selectively switching and operating the 1st antenna radiator and the 2nd antenna radiator according to the present invention exhibits the efficiencies of 51% at a band of GSM900, 40% at a band of DCS1800, 60% at a band of WCDMA Band1, and 39% at a band of LTE Band11. These efficiency values are comparable to the performance realizable with the use of two PIFAs which are separately mounted and isolated. Thus, in the present embodiments, by operating two antenna radiators in proximity to each other, approximately the same radiation performance is achieved while minimizing an antenna mounting space and making efficient use of space within the portable terminal.

The radiating portion 41 of the 2nd antenna radiator is arranged in a position to achieve coupling with at least one of the at least two radiating portions 33, 34 of the 1st antenna radiator 30. In the exemplary embodiments illustrated in FIGS. 2-4, the radiating portion 41 is composed of an input portion ("L-portion") resembling an inverted L antenna, and an output portion ("T-portion") resembling a T-aerial type antenna with left and right horizontal arms. The left and right arms can be of different lengths, forming an asymmetrical T-portion as shown in the example of FIGS. 2-4, where the left arm is longer than the right arm. The input inverted-L type portion has a short segment connected to ground pad 17 and oriented parallel to conductor 32; this short segment is bent at a right angle such that a major central portion extends in a direction parallel to the arms of the T-portion. The T-portion has an input segment perpendicular to, and beginning at, the end of the central portion. The open end of radiator 34 extends into a region coinciding with the right arm of the T-portion. In any event, it is understood that other configurations are possible for antenna radiator 40.

In the exemplary embodiments illustrated in FIGS. 2-4, the radiating portion 33 has a near end portion (left portion) in the shape of an L, and a far end (right end) portion in the shape of a U. The near end portion has an input side extending from the grounding portion 32 as a continuous conductor. The output end (open end) of the U portion runs parallel to radiating portion 34. The U portion enables the antenna radiator 30 to be provided with a relatively long length for efficient operation at the lower bands. In any event, it is understood that other configurations are possible for antenna radiator 30.

As described above, exemplary embodiments of the present invention arrange different antenna radiators having a relatively large band shift together and efficiently operate the antenna radiators. This results in the benefit of reducing a mounting space and making a contribution to the slimming of the device, and saving a manufacturing cost of the device.

Manufacturing cost is saved by not realizing a separate antenna deployed in a separate isolated position as in conventional designs.

Moreover, exemplary embodiments of the present invention have the effect of expanding a bandwidth of an existing antenna radiator and realizing an excellent radiation characteristic. Bandwidth is expanded by providing a floating dummy pattern acting as a sub antenna radiator, which is coupled with the existing antenna radiator.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. A built-in antenna for an electronic device, the antenna comprising:

a substrate having a conductive area and a non-conductive area;

a carrier disposed on the substrate;

a 1st antenna radiator comprising at least first and second radiating portions, wherein the 1st antenna radiator is fed by a Radio Frequency (RF) end, and a grounding portion of the 1st antenna radiator is connected to the conductive area;

a 2nd antenna radiator configured to operate at a band different from respective operating bands of the at least first and second radiating portions of the 1st antenna radiator, and fed by the RF end in a position adjacent to the 1st antenna radiator; and a switching element to switch the RF end between the 1st antenna radiator and the 2nd antenna radiator;

wherein the carrier comprises a top surface, a side surface and a tapered section, the side surface extends perpendicularly from the top surface, and the tapered section is provided between the top surface and the side surface; and wherein a majority portion of the 1st antenna radiator is disposed on the op surface and a majority portion of the 2nd antenna radiator is disposed on the tapered section.

2. The built-in antenna of claim 1, wherein, when the 1st antenna radiator is operated by the switching element, the 2nd antenna radiator is electromagnetically coupled with the 1st antenna radiator and is used as a floating dummy pattern, wherein the coupling is sufficient to expand an operating bandwidth of the 1st antenna.

3. The built-in antenna of claim 1, wherein a radiating portion of the 2nd antenna radiator is arranged in a position to achieve coupling with at least one of the at least first and second radiating portions of the 1st antenna radiator.

4. The built-in antenna of claim 3, wherein, when the 1st antenna radiator is operated by the switching element, the radiating portion of the 2nd antenna radiator is electromagnetically coupled with at least one of the radiating portions of the 1st antenna radiator and is used as a floating dummy pattern.

5. The built-in antenna of claim 3, wherein a spaced distance between any one of the radiating portions of the 1st antenna radiator and the radiating portion of the 2nd antenna radiator has a range of about 0.5 millimeter (mm) to 5 mm.

6. The built-in antenna of claim 1, wherein, when the 2nd antenna radiator is operated by the switching element, the 1st antenna radiator is disconnected from the RF end.

7. The built-in antenna of claim 1, wherein the 1st antenna radiator comprises:

the 1st radiating portion operating at a band of Global Systems for Mobile communication (GSM) 900; and the 2nd radiating portion operating at bands of Digital Cellular Service (DCS) 1800, Personal Communications Service (PCS) 1900, and Wireless Code Division Multiple Access (WCDMA) Band1, and wherein the 2nd antenna radiator comprises a 3rd radiating portion operating at a Long Term Evolution (LTE) band.

8. The built-in antenna of claim 7, wherein the 2nd radiating portion of the 1st antenna radiator is constructed to be arranged in a position electromagnetically coupled to the 3rd radiating portion of the 2nd antenna radiator.

9. The built-in antenna of claim 8, wherein, when the 1st antenna radiator is operated by the switching element, the 3rd radiating portion of the 2nd antenna radiator is used as a floating dummy pattern for expanding a bandwidth of the 2nd radiating portion of the 1st antenna radiator.

10. The built-in antenna of claim 1, wherein the switching element is at least one of a Micro Electro Mechanical System (MEMS), a Field Effect Transistor (FET), and a diode.

11. The built-in antenna of claim 1, wherein the top surface having a uniform height with respect to a top surface of the substrate.

12. The built-in antenna of claim 1, wherein the 2nd antenna radiator is a monopole type antenna having an input portion including an elongated section, and a T-shaped output portion connected to the elongated section, with left and right arms of the T-shaped output portion being parallel to the elongated section.

13. The built-in antenna of claim 1, wherein at least one of the 1st antenna radiator and the 2nd antenna radiator is one of a plate type conductor or a flexible printed circuit comprising a conductor pattern.

14. The built-in antenna of claim 12, wherein the elongated section and the T-shaped output portion are both arranged on the tapered section of the carrier.

15. The built-in antenna of claim 1, wherein the 1st antenna radiator further comprises a minority portion disposed partly on the tapered section and partly on the side surface, the minority portion comprising an input feed portion and the grounding portion.

16. The built-in antenna of claim 1, wherein the 2nd antenna radiator further includes a minority portion disposed partly on the side surface, the minority portion comprising an input feed portion for the second antenna radiator.

* * * * *